US005941389A

United States Patent [19]

Gomes

[11] Patent Number: 5,941,389

[45] Date of Patent: Aug. 24, 1999

[54] WRAP-AROUND CARRIER WITH REINFORCING FLAPS

[75] Inventor: Jean-Manuel Gomes, Marietta, Ga.

[73] Assignee: Riverwood International Corporation, Atlanta, Ga.

[21] Appl. No.: 09/168,189

[22] Filed: Oct. 7, 1998

[51] Int. Cl.[6] ..... B65D 75/00

[52] U.S. Cl. ..... 206/427; 206/433

[58] Field of Search ..... 206/145, 147, 206/152, 427, 433, 434

[56] References Cited

U.S. PATENT DOCUMENTS 3,258,190 6/1966 Wood ..... 206/433

5,520,283 5/1996 Sutherland ..... 206/427 X

*Primary Examiner*—Jacob K. Ackun

[57] ABSTRACT

A wrap-around carrier and carrier blank for forming the carrier for containing a plurality of articles, with the carrier including a top panel, opposite side panels foldably connected to the top panel, and a bottom positioned opposite the top panel. Bevel panels are foldably connected to the bottom panel and to the side panels and each includes apertures located near the lower side portions of the articles contained in the carrier. An outboard reinforcing flap is positioned adjacent each one of the outboard ones of the apertures and the reinforcing flaps are foldably connected to the bevel panels. An outboard edge of each of each of the outboard reinforcing flaps is substantially aligned with an end of the carrier to reinforce the carrier to prevent outboard ones of articles contained in the carrier from being dislodged.

16 Claims, 4 Drawing Sheets

WRAP-AROUND CARRIER WITH REINFORCING FLAPS

TECHNICAL FIELD

The present invention relates to wrap-around carriers which contain heel cut-outs or apertures for holding the bottom portions of adjacent round articles (for example bottles or cans) in place. In particular, the invention relates to such a wrap-around carrier having reinforcing flaps for preventing the carrier from tearing adjacent such heel cut-outs.

BACKGROUND OF THE INVENTION

Wrap-around carriers typically are drawn tightly about articles to be packaged in order to prevent the articles from moving toward the open ends of the carrier during shipment and handling. To further ensure a secure package, wrap-around carriers which are designed to accommodate beverage bottles or cans are normally provided with cut-outs in the side panels to allow the bottom or heel portion of the bottles or cans to extend out partly through the side of the carrier. As a result, the bottles or cans are better held in place by the grip between the bottom portion of the bottle or can and the side edges of the cut-outs.

For example, U.S. Pat. No. 5,520,283 of Sutherland relates to a wrap-around carrier having cut-outs and article retaining flaps for helping to hold bottles or cans in the cut-outs. Likewise, U.S. Pat. No. 5,310,050 also of Sutherland relates to a wrap-around carrier with a flexible heel aperture for securely holding petaloid-shaped bottles in place. These patents are good examples of efforts in the past to provide a good grip on bottles or cans at such cut-outs or apertures.

In the use of known wrap-around carriers, a problem can arise during the filling and transport of the carriers. In particular, the outer material adjacent outboard ones of the cut-outs can be damaged as the carrier is moved along a filling and packaging line. In a bottling plant, the carriers are filled with bottles or cans and moved along a line in nose-to-tail fashion. Thus, the leading edge of one carrier is positioned adjacent the trailing edge of an adjacent carrier. As the filled carriers are moved along they are frequently jostled and bumped, resulting in damage to the ends of the carriers. In particular, the carriers are susceptible to damage adjacent the material next to the heel cut-outs at the ends of the carriers. If this material becomes torn or weakened, a bottle or can can become dislodged and fall out.

Accordingly, it can be seen that a need yet remains for a wrap-around style carrier having heel cut-outs or heel apertures for retaining bottles or cans and which is reinforced to prevent destruction or compromise of the material adjacent outboard ones of the heel cut-outs. It is to the provision of such a wrap-around carrier that the present invention is primarily directed.

SUMMARY OF THE INVENTION

Briefly described, in a first preferred form the present invention comprises a wrap-around carrier for containing a plurality of articles. Such articles could include beverage bottles or cans. Each article is of the type having a bottom and a curved lower side portion adjacent the bottom. The wrap-around carrier includes a top panel and opposite side panels foldably connected to the top panel. A bottom panel is positioned opposite the top panel. Opposite bevel panels are foldably connected to the bottom panel and to the side panels. Each of the bevel panels includes apertures located adjacent the lower side portions of the articles. An outboard reinforcing flap is positioned adjacent each of the outboard ones of the apertures. The reinforcing flaps are each foldably connected to one of the bevel panels. An outboard edge of each outboard reinforcing flap is substantially aligned with an end of the carrier.

Preferably, the reinforcing flap is formed from material folded out of the way to create at least part of the aperture. Preferably, the reinforcing flaps are formed adjacent four outboard corners of the carrier. Also preferably, the reinforcing flaps are foldably connected to the bevel panels adjacent the apertures.

In one form of the invention, the reinforcing flaps closely conform to the shape of the carrier thereat. In another form, the reinforcing flaps span the bevel panels, extending from adjacent the bottom panel to adjacent the nearest side panel. In this second form, the reinforcing flaps create a space between the reinforcing flap and the associated bevel panel.

In one preferred form, the reinforcing flaps each include two flat flap portions foldably connected to one another. In another preferred form, the reinforcing flaps each include three flat flap portions foldably connected to one another. In each embodiment, preferably the reinforcing flaps each includes a lower reinforcing flap panel adjacent the bottom and extending substantially parallel thereto.

In another preferred form of the invention, the invention comprises a carrier blank for forming a wrap-around carrier for containing a plurality of articles, such as beverage bottles or cans of the type having a bottom and a curved lower side portion adjacent the bottom of the article. The carrier blank comprises a top panel and first and second opposite side panels flanking the top panel and each foldably connected thereto. The carrier blank further includes first and second bottom panels flanking the side panels for forming a carrier bottom opposite the top panel.

The carrier blank also includes first and second opposite bevel panels extending between and foldably connected to the bottom panels and the side panels, with each of the bevel panels including a plurality of heel cut-outs for receiving heel portions of the articles. The heel cut-outs at least partly define a plurality of reinforcing flaps positioned adjacent thereto, with the reinforcing flaps being foldably connected to the bevel panels and having edges which, when the reinforcing flaps are folded away from the heel cut-outs, are substantially aligned with an edge of the carrier blank.

In one form of a carrier blank according to the present invention, the reinforcing flaps are adapted to closely conform to a shape of the wrap-around carrier adjacent the bevel panels. In this form, the reinforcing flaps include three substantially flat flap portions.

In another form of the carrier blank, the reinforcing flaps span the bevel panels and extend from adjacent the bottom-panels to adjacent the side panels. In this form, the reinforcing flaps preferably each include two substantially flat flap portions foldably connected to one another.

Wrap-around carriers and carrier blanks according to the invention have numerous advantages. For example, such carriers and a carrier blanks exhibit increased strength near the heel cut-outs. Moreover, as a result of this increased strength, they resist tearing at these heel cut-outs. This improves retention of articles in the wrap-around carrier, particularly during the packaging and shipping of the carriers. This is particularly helpful in avoiding damage or destruction of the carriers due to jostling and bumping of the ends of the carriers.

The carriers and carrier blanks also exhibit improved strength without requiring additional paperboard to form the blank. Also, the improved strength at the ends of the carriers is provided at minimal or no additional cost. Such blanks and wrap-around carriers have improved end-to-end strength and are easily manufactured.

Accordingly, it is an object of the present invention to provide a wrap-around carrier with heel cut-outs and a carrier blank therefor which exhibit increased strength near the heel cut-outs.

It is another object of the present invention to provide a wrap-around carrier and a carrier blank which resist tearing near the heel cut-outs.

It is another object of the present invention to provide a wrap-around carrier which exhibits improved retention of articles contained therein, particularly during packaging and shipping.

It is another object of the present invention to provide a wrap-around carrier and carrier blank with improved strength without requiring additional paperboard to form the carrier blank.

It is another object of the present invention to provide a wrap-around carrier with improved end-to-end strength.

It is another object of the present invention to provide a wrap-around carrier and carrier blank which are easily manufactured, have improved strength, and can be manufactured at little or no additional manufacturing cost.

These and other objects, features, and advantages of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENTS

Figure 1:
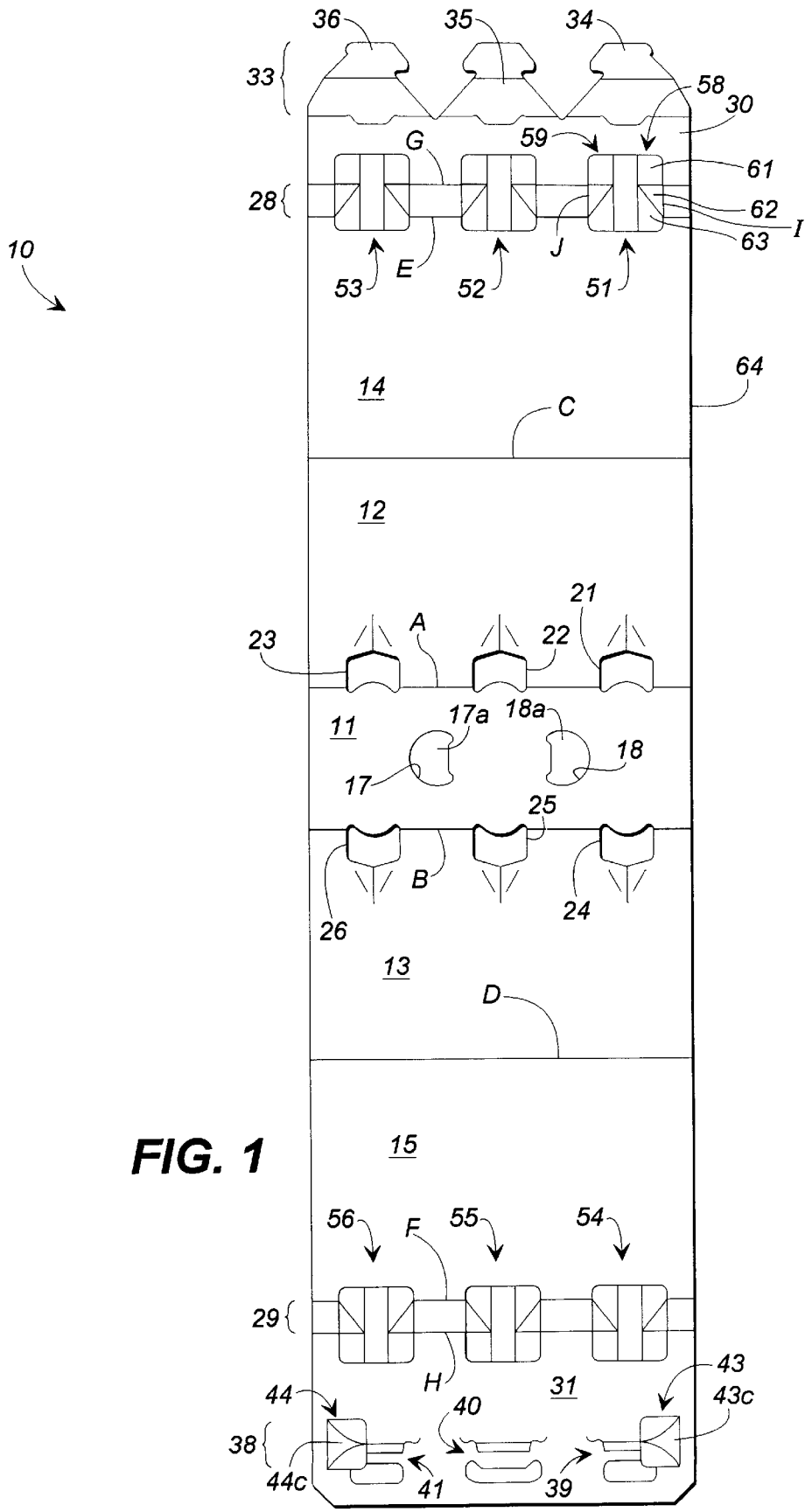
FIG. 1 is a plan view of a carrier blank for forming a wrap-around carrier according to a preferred form of the invention.
Figure 2:
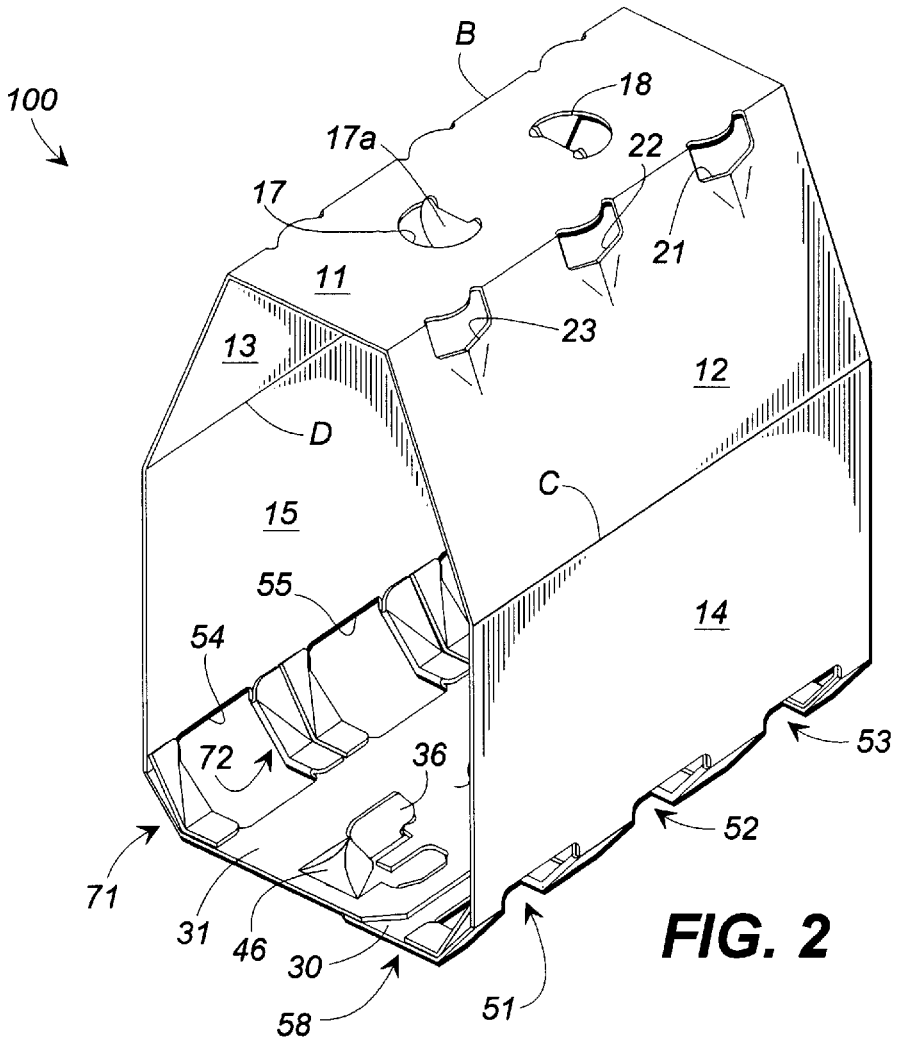
FIG. 2 is a perspective illustration of a wrap-around carrier made from the carrier blank of FIG. 1.

Referring now in detail to the drawing figures, wherein like reference numerals depict like parts throughout the several views, FIG. 1 shows a carrier blank 10 for forming a wraparound carrier 100 as shown in FIG. 2. The carrier blank 10 includes a top panel 11 foldably connected to and flanked by first and second upper side panels 12 and 13. In turn, the upper side panels 12 and 13 are flanked by and foldably connected to lower side panels 14 and 15. Lower side panel 14 and upper side panel 12 constitute one side portion of the carrier blank, while upper side panel 13 and lower side panel 15 constitute an opposite side portion of the carrier blank. The top panel 11 is substantially rectangular and has finger holes 17 and 18 temporarily filled with finger flaps 17*a* and 18*a*. Article positioning cut-outs 21–26 are positioned along fold lines A and B at the foldable juncture of the top panel 11 to the upper side panels 12 and 13.

In the illustrative embodiment depicted in the drawing figures, a 2×3 arrangement is shown and is shown in particular for use in containing bottles. In this regard, the sides of the carrier are made in two pieces (an upper half and a lower half) in order to better conform to the tapered shape of bottles. The upper side panels 12 and 13 are foldably connected to the lower side panels 14 and 15 along fold lines C and D, respectively. Of course, those skilled in the art will recognize that the principles of the present invention can be applied to a wrap-around carrier for cans as well, with only minor modifications.

Bevel panels 28 and 29 are foldably connected to the lower side panels 14 and 15 along fold lines E and F, respectively. Bottom panels 30 and 31 are in turn foldably connected to the bevel panels 28 and 29 along fold lines G and H, respectively.

The bottom panel 30 includes a male locking mechanism 33 positioned along a distal edge thereof. The male locking mechanism 33 includes male locking tabs 34–36. The other bottom panel 31 includes female locking means 38, including female lock openings indicated generally at 39–41. The male locking mechanism 33 cooperates with the female locking means 38 to lock the two bottom panels together after the carrier blank is wrapped around a plurality of articles. Such locking mechanisms are well-known in the industry and further discussion of same is unnecessary here.

Bottom panel 31 includes a pair of substantially rectangular wedge flaps 43 and 44 which each include three small panels foldably connected to one another, with the central panel 43*c*, 44*c* foldably connected to bottom panel 31. Such wedge flaps cooperate with the ends of the male lock tabs 34 and 36 such that during the filling, closing and locking of the carrier blank to form a filled carrier 100 as shown in FIG. 2, the wedge flaps 43 and 44 form wedge-shaped chocks which help to position bottles or cans in the carrier. For example, as shown in FIG. 2, the finished carrier 100 includes a wedge-shaped chock 46 which stands proud of the upper surface of the bottom of the carrier and is held in such a proud position by the upstanding lock tab 36. The carrier 100 also includes a second upstanding wedge-shaped chock at the other end of the carrier (unshown in this view as it is obscured by other features).

Referring once more to Fig. 1., the carrier blank 10 can be seen to include a plurality of substantially square heel cut-outs, such as heel cut-outs 51–56. Each of the heel cut-outs is substantially square with rounded corners and extends from the lower side panels 14, 15 across the bevel panels 28, 29 to the bottom panels 30, 31. These substantially square heel cut-outs 51–56 are partially (and temporarily) filled each by a pair of flaps each foldably connected along opposite side edges of the cut-outs 51–56. For example, cut-out 51 is partially covered by a first rectangular foldable flap 58 and a second foldable flap 59 positioned opposite thereto. Each of these rectangular foldable flaps in these heel cut-outs operates as a reinforcing flap. The reinforcing flaps are foldably connected to the bevel panels. For example, reinforcing flaps 58 and 59 are foldably connected to bevel panel 28 along fold lines I and J, respectively. Moreover, each of the reinforcing flaps comprises three small panels foldably connected to one another. For example, rectangular reinforcing flap 58 includes a lower or bottom panel 61, a medial, triangular-shaped panel 62 foldably connected thereto, and an upper, substantially triangular-shaped panel 63 foldably connected to the medial panel 62. Rectangular reinforcing flap 59 is a mirror image of the construction of rectangular reinforcing flap 58. The reinforcing flaps partially covering the other heel cut-outs in the carrier blank 10 are of identical construction.

It should be noted that it is preferred, but not required that, the width of the reinforcing flap 58 and the distance of the fold line I from an outboard edge 64 of the carrier blank 10 are selected such that when the reinforcing flap 58 is folded about fold line I, an outboard edge of the reinforcing flap 58 lies coextensive with, and is aligned with, outboard edge 64 of the carrier blank 10. This matching of the distance of the fold line and the width of the reinforcing flap ensures that the heel cut-outs adjacent the outboard edges of the carrier blank 10 are reinforced.

Figure 3:
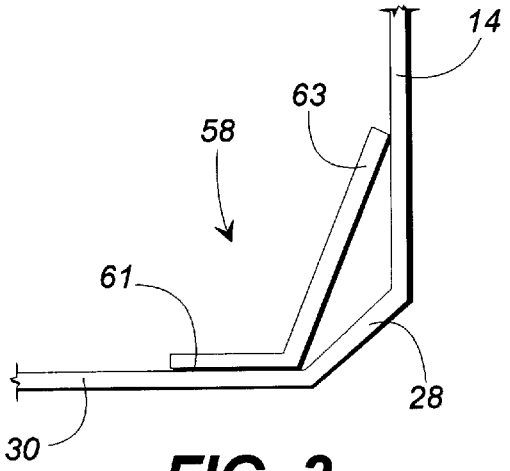
FIG. 3 is an end view of a portion of the wrap-around carrier of FIG. 2.

As shown clearly in FIG. 2, each of the heel cut-outs in the finished carrier 100 is reinforced by an opposite pair of reinforcing flaps flanking the heel cut-outs. For example, heel cut-out 54 is reinforced by an opposite pair of reinforcing flaps 71 and 72. As previously described, each of the reinforcing flaps is foldably connected along one edge to the bevel panels, while the other edge is distal therefrom. As shown in FIG. 2, and as more clearly shown in FIG. 3, a portion of each of the reinforcing flaps spans the bevel panels from the bottom of the carrier to an adjacent side. For example, as shown in FIGS. 2 and 3, the reinforcing flap 58 includes a lower panel portion 61 which is positioned against and substantially parallel to bottom panel 30. The medial panel portion (unshown in this figure) of the reinforcing flap 58 and the upper panel portion 63 are folded and extend at an angle relative to bottom portion 61. Moreover, the length of the upper portion 63 (and the unshown medial portion 62) are selected to span the bevel panel, such as bevel panel 28, and to engage the side panel, such as lower side panel 14. In this way, a space or gap is created between the reinforcing flap 58 and the bevel panel 28 and a portion of the lower side panel 14. It will be appreciated that this space or gap is created along the end (outer) edges of the carrier 100 and the space or gap is not maintained all across the reinforcing flap. Indeed, the opposite edge of each reinforcing flap is foldably connected to the bevel panels. Thus, the gap or space tapers from a maximum, such as shown in FIG. 3, to zero. By creating the space or gap at the outboard edges or end edges of the finished carrier 100, the strength of the finished carrier 100 in the region of the outboard ones of the heel cut-outs is improved and is improved by more than simply doubling the material inasmuch as the reinforcing flap creates a structure in effect similar to a honeycomb, which exhibits substantial strength in a direction parallel to the walls of the honeycomb.

Notably, the reinforcing flaps operate to reinforce the bevel panels in the region of the heel cut-outs without requiring that the width of the carrier blank 10 be extended. Indeed, the reinforcing flaps are made from material that is normally punched out and thrown away. Normally, in the prior art it has been common to create heel cut-outs by punching out the entire hole. The present invention advantageously leaves a little of the material foldably attached to the bevel panel, which material otherwise would be thrown away. Thus, the bevel panels can be reinforced in the vicinity of the heel cut-outs at little or no cost.

Figure 4:
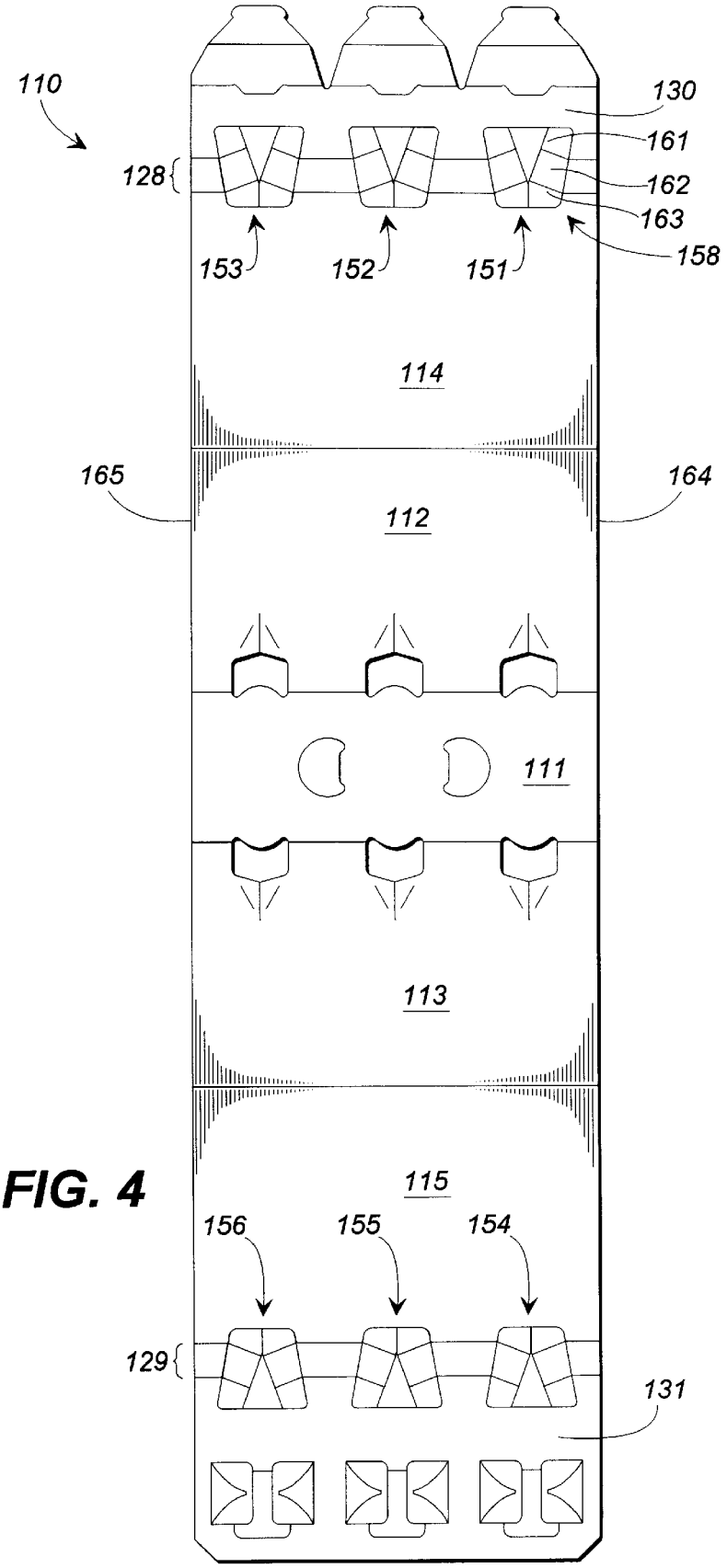
FIG. 4 is a plan view of a carrier blank for forming a wrap-around carrier according to a second preferred form of the invention.
Figure 5:
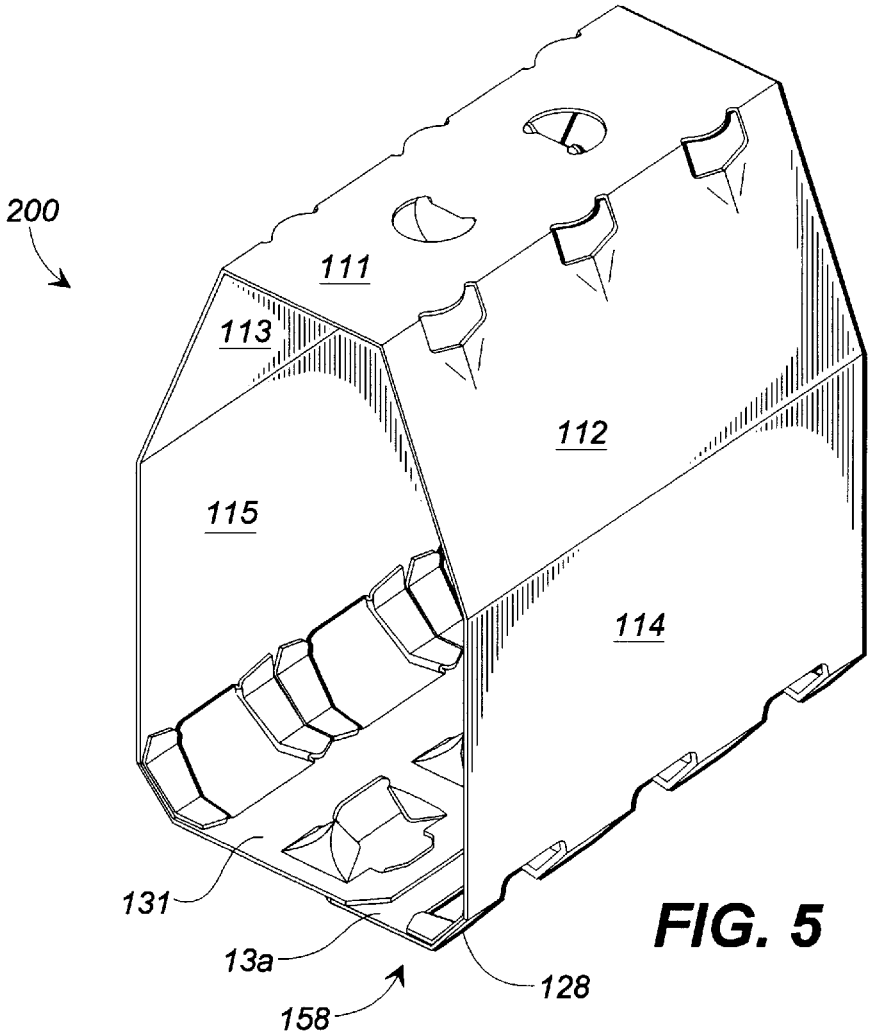
FIG. 5 is a perspective illustration of a wrap-around carrier made from the carrier blank of FIG. 4.

FIG. 4 shows an alternate embodiment. In particular, FIG. 4 shows a carrier blank 110 for forming a finished carrier 200 (as shown in FIG. 5). The carrier blank 110 is similar in many respects to the carrier blank 10 of FIG. 1. Accordingly, a repetitive statement of such features is unnecessary here. In addition to changes in the locking mechanism for locking the bottom panel 130 to the other bottom panel 131 and the addition of more wedge-shaped chocks, the carrier blank 110 differs in the details of the reinforcing flaps (according to the general principles of the invention just described, but in a slightly modified form). As shown in FIG. 4, the heel cut-outs 151–156 are not square, but rather are trapezoidal. The reinforcing flaps formed along the edges of the heel cut-outs are no longer rectangular. Moreover, the reinforcing flaps are foldably connected to the bevel panels 128 and 129 along fold lines which are not perpendicular to the bevel panels. Rather, the fold lines at which the reinforcing flaps are connected to the bevel panels are oriented at a small acute angle. Moreover, the reinforcing flaps themselves are tapered at an angle that matches that small acute angle such that when the reinforcing flaps are folded about their fold lines, the outboard edges of the reinforcing flaps are parallel to outboard edges 164 and 165 of the carrier blank 110. Moreover, the outermost reinforcing flaps, when folded about their fold lines, include outboard edges which lie coextensive with and aligned with outboard edges or end edges 164 and 165 of the carrier blank 110 in order to reinforce the ends of the finished carrier 200 (see FIG. 5).

Figure 6:
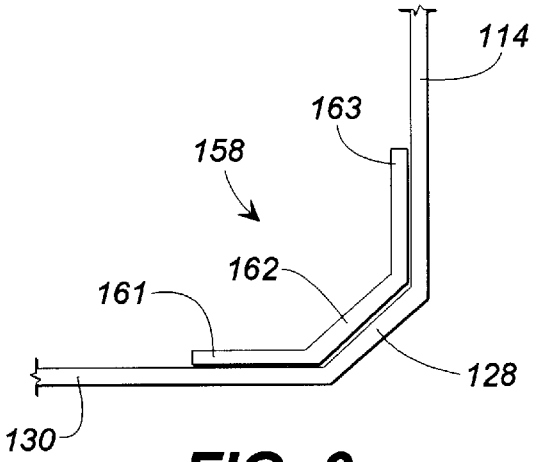
FIG. 6 is an end view of a portion of the wrap-around carrier of FIG. 5.

Each of the reinforcing flaps includes three reinforcing flap panels foldably connected to one another. For example, reinforcing flap 158 include a bottom panel 161, a medial panel 162 foldably connected thereto, and a top panel 163 foldably connected to the medial panel 162. The height of the medial panel 162 is selected to match substantially the height of the bevel panel 128 and the fold lines separating the three reinforcing flap panels are positioned and oriented to line up with the fold lines E', F' and G', H' when the reinforcing flaps are folded over. Thus, when the reinforcing flap is folded about its fold line, the medial panel 162 lies closely adjacent the bevel panel 128, while lower panel 161 lies closely adjacent the bottom of the carrier, and the upper panel 163 lies closely adjacent one of the sides of the carrier. This is shown in FIG. 5. Moreover, FIG. 6 more plainly shows this feature of having the reinforcing flaps closely matching the shape or contour of the carrier in the region being reinforced by the reinforcing flap. As shown in FIG. 6, reinforcing flap 158 lies closely adjacent lower side panel 114, bevel panel 128, and bottom panel 130. In particular, the upper panel portion 163 of the reinforcing flap 158 lies closely adjacent lower side panel 114, while medial panel 162 lies closely adjacent bevel panel 128, and lower panel 161 lies closely adjacent and over bottom panel 130.

While the invention has been disclosed in preferred forms, it will be apparent to those skilled in the art that many modifications, additions, and deletions can be made therein without departing from the spirit and scope of the invention as set forth in the following claims.

I claim:

1. A wrap-around carrier for containing a plurality of articles, such as beverage bottles or cans of the type having a bottom and a curved lower side portion adjacent the bottom of the article, said wrap-around carrier comprising:

a top panel;

opposite side panels foldably connected to said top panel;

a carrier bottom positioned opposite said top panel;

opposite bevel panels foldably connected to said carrier bottom and to said side panels, each of said bevel panels including an aperture located adjacent the lower side portion of each of the articles; and a plurality of outboard reinforcing flaps positioned adjacent each of the outboard ones of the apertures, with said reinforcing flaps being foldably connected to said bevel panels and having outboard edges which are substantially aligned with an end of said wrap-around carrier.

2. A wrap-around carrier as claimed in claim 1 wherein said reinforcing flaps are each formed from material folded out of the way to create said apertures.

3. A wrap-around carrier as claimed in claim 2 wherein said reinforcing flaps include at least four reinforcing flaps formed adjacent four outboard corners of said wrap-around carrier.

4. A wrap-around carrier as claimed in claim 1 wherein said reinforcing flaps are foldably connected to said bevel panels adjacent said apertures.

5. A wrap-around carrier as claimed in claim 1 wherein said reinforcing flaps closely conform to a shape of said wrap-around carrier adjacent said bevel panels.

6. A wrap-around carrier as claimed in claim 1 wherein portions of said reinforcing flaps span said bevel panels, extending from adjacent said bottom panel to adjacent said side panels.

7. A wrap-around carrier as claimed in claim 6 wherein said reinforcing flaps are spaced from said bevel panels.

8. A wrap-around carrier as claimed in claim 1 wherein said reinforcing flaps each include two substantially flat flap portions foldably connected to one another.

9. A wrap-around carrier as claimed in claim 1 wherein said reinforcing flaps each include three flat flap portions foldably connected to one another.

10. A wrap-around carrier as claimed in claim 1 wherein said reinforcing flaps each include a lower reinforcing flap panel adjacent said bottom panel and extending substantially parallel thereto.

11. A carrier blank for forming a wrap-around carrier for containing a plurality of articles, such as beverage bottles or cans of the type having a bottom and a curved lower side portion adjacent the bottom of the article, said carrier blank comprising:

a top panel;

first and second opposite side panels flanking said top panel and each foldably connected thereto;

first and second bottom panels flanking said side panels for forming a carrier bottom opposite said top panel;

first and second opposite bevel panels extending between and foldably connected to said bottom panels and said side panels, each of said bevel panels including a plurality of heel cut-outs for receiving heel portions of the articles; and said heel cut-outs at least partly defining a plurality of reinforcing flaps positioned adjacent thereto, with said reinforcing flaps being foldably connected to said bevel panels and having edges which, when said reinforcing flaps are folded away from said heel cut-outs, are substantially aligned with an edge of said carrier blank.

12. A carrier blank as claimed in claim 11 wherein said bevel panels each include at least two reinforcing flaps.

13. A carrier blank as claimed in claim 11 wherein said reinforcing flaps are adapted to conform to a shape of the finished wrap-around carrier adjacent said bevel panels.

14. A carrier blank as claimed in claim 11 wherein said heel cut-outs are partly formed also in said bottom panels and in said side panels and wherein said reinforcing flaps span said bevel panels, extending from adjacent said bottom panels to adjacent said side panels.

15. A carrier blank as claimed in claim 11 wherein said reinforcing flaps each include two substantially flap portions foldably connected to one another.

16. A carrier blank as claimed in claim 11 wherein said reinforcing flaps each include three substantially flat portions foldably connected to one another.

* * * * *